US005911460A

United States Patent [19]

Hawkins et al.

[11] Patent Number: 5,911,460

[45] Date of Patent: Jun. 15, 1999

[54] JAMB POCKET LATCH BOLT ASSEMBLY RELEASE APPARATUS

[75] Inventors: J. Riley Hawkins, Atlanta; Larry Tew, Smyrna; Nicole E. Hawkins, Atlanta; Michael Perdue, Suwanee; Mark Tew, Stockbridge, all of Ga.

[73] Assignee: Georgia Tech Research Corp., Atlanta, Ga.

[21] Appl. No.: 08/805,986

[22] Filed: Feb. 25, 1997

[51] Int. Cl.[6] ..... E05B 17/22

[52] U.S. Cl. ..... 292/254; 292/255; 292/144; 292/DIG. 25

[58] Field of Search ..... 292/254, 255, 292/144, 109, DIG. 25; 70/280; 49/279, 280; 109/1–6

[56] References Cited

U.S. PATENT DOCUMENTS

| | | | |
|---|---|---|---|
| 947,866 | 2/1910 | Taylor | 292/144 |
| 2,733,918 | 2/1956 | Fischer | 49/280 |
| 3,521,921 | 7/1970 | Miyazaki | 292/201 |
| 3,614,147 | 10/1971 | Spector | 292/254 |
| 4,135,377 | 1/1979 | Kleefeldt et al. | 70/280 |
| 4,216,743 | 8/1980 | Cohen | 49/171 |
| 4,671,086 | 6/1987 | Fogleman et al. | 70/277 |
| 4,679,834 | 7/1987 | Gotanda | 292/169 |
| 4,902,052 | 2/1990 | Caine | 292/254 |
| 5,009,456 | 4/1991 | Eck . | |
| 5,095,654 | 3/1992 | Eccleston | 49/280 |
| 5,261,260 | 11/1993 | Lin . | |
| 5,263,347 | 11/1993 | Allbaugh et al. . | |
| 5,351,512 | 10/1994 | Pearlman | 292/144 |
| 5,474,342 | 12/1995 | Smith et al. | 292/254 |
| 5,490,698 | 2/1996 | Dezso | 291/DIG. 25 |
| 5,531,086 | 7/1996 | Bryant . | |
| 5,628,216 | 5/1997 | Qureshi et al. . | |
| 5,636,536 | 6/1997 | Kinnucan . | |
| 5,678,436 | 10/1997 | Alexander . | |

*Primary Examiner*—Michael F. Trettel
*Assistant Examiner*—Fredrick Conley
*Attorney, Agent, or Firm*—Deveau, Colton & Marquis

[57] ABSTRACT

An electro-mechanical jamb pocket latch bolt assembly release which is adapted to be installed in a conventional door jamb behind the strike plate. When activated, a ram element of the apparatus will eject the latch bolt assembly from the door jamb allowing the door to swing freely upon contact with the door. The present invention allows for easy installation without a carpenter or electrician, and without specialized tools and is particularly suited for use by handicapped individuals.

14 Claims, 8 Drawing Sheets

JAMB POCKET LATCH BOLT ASSEMBLY RELEASE APPARATUS

BACKGROUND OF THE INVENTION

1. Field of the Invention

This invention relates generally to a latch bolt assembly ejection device for installation in the jamb pocket behind the strike plate of a conventional door. The invention enables a user to unlatch a door without using the door knobs or handles. In particular, this invention relates to an electromechanical jamb pocket latch bolt assembly release that, when activated, will expel the latch bolt assembly from the jamb pocket enabling the door to swing freely. This invention can easily be installed in an existing door frame personally by a premises owner, without the need for specialized tools or knowledge, and without the need or expense of a carpenter. and/or an electrician, typically requiring only a screwdriver and a drill for installation.

2. Description of Related Art

Conventional door latching devices frequently go unnoticed because these devices are used many times a day, everyday, and become so routine to operate that the steps required to open a latched door are often performed unconsciously. While the standard latching device is generally suited for most applications, including latching the interior and exterior doors of a home or office, the act of disengaging a latch bolt assembly from the jamb pocket in a conventional door is not routine or easy for every user. The conventional unlatching device is particularly unsuited for those individuals who may have difficulty accessing or operating the knob or handle of a conventional door latch assembly. Thus, it has been found that, there exists a need for a device which enables individuals to unlatch a standard door without utilizing knobs or handles in situations where the use of knobs or handles to unlatch a door is difficult, cumbersome, or even impossible.

The present invention is primarily adapted for use in conjunction with a standard residential or office door, which will now be briefly described to assist in an understanding of the present invention. The standard door is hingedly connected to the door frame, typically by three hinges, one each located at the top, middle, and bottom of the door, respectively. The latching device and knobs are located in proximity to the doorwidth (i.e., the edge of the door) opposite the doorwidth hingedly connected to the door frame.

The standard door may swing between an open and a closed position. In the open position, the door is capable of swinging freely on the door's hinges that pivotally connect the door to the door frame. In the closed position, the door can be releasably latched to the door frame by means of a door latching device. In some embodiments, the door latching device can be locked, depending on the sophistication of the latching device. If the door latching device can lock, the device must be unlocked before the door can be unlatched from the door frame. In most instances, latching and unlatching the door from the door frame is accomplished by the use of door knobs or handles.

The conventional door latching device generally comprises the following components: a latch bolt assembly; door knobs; a mechanism to control the position of the latch bolt assembly as directed by the door knobs; and a jamb pocket. The latch bolt assembly is typically a spring-biased element or elements which protrude through a mortise in the front plate. The front plate is a generally flat, metallic component that is fastened to the doorwidth adjacent the door knob(s). The latch bolt assembly may comprise both a latch bolt and a trigger bolt, or, depending on the level of sophistication, the latch bolt assembly may comprise of a latch bolt alone, without a trigger bolt. Both the latch and trigger bolts slideably move through a mortise in the front plate. For simplicity, attention will be directed to door latching devices that comprise a latch bolt alone. The present invention, however, is operable with any type of latch bolt assembly regardless of sophistication, as long as the latch bolt assembly can be slideably collapsed and ejected from the jamb pocket upon the application of a lateral pushing force.

The latch bolt assembly can slideably move between a retracted position flush with the front plate, to an extended position protruding past the front plate. Typically, the latch bolt assembly is spring-biased toward the extended position. When the door is in the closed position, the latch bolt assembly extends past the front plate and into a corresponding cavity in the door jamb, herein designated as the jamb pocket, latching the door. A strike plate is typically provided on the door jamb, and is provided with a mortise or opening therethrough which defines the entranceway to the jamb pocket. The strike plate typically is a generally flat, metallic component, that incorporates a rounded edge which follows the contour of the door jamb.

The conventional door latching device typically further includes both an inner and an outer door knob or handle, which are fixed on the inner and outer surfaces of the door, respectively, in proximity to the latch bolt assembly. Some door latching devices enable only one door knob to direct the latch bolt assembly, leaving the other free to rotate without affecting the latch bolt position. Other door latching devices employ locking devices in the form of push buttons or keys which disable that door knob to direct the latch bolt assembly until the locking device is disarmed.

The mechanisms to control the position of the latch bolt assembly as directed by the door knobs can vary among the numerous door latching devices, as one with ordinary skill in the art will understand. For example, cylindrical key-in-knob locks have a keyed outside knob. The outside knob is connected to a cylinder protruding from a chassis which in turn leads to the latch bolt assembly. Rotation of the outside knob controls displacement of the latch bolt assembly. In tubular privacy locks, which are used on interior doors to prevent entry, the inside knob, which is provided with a push button or thumb turn for locking and unlocking the assembly, extends outwardly from a spindle which in turn connects to the latch bolt assembly.

Lastly, the jamb pocket is the cavity located in the door jamb, behind the strike plate, which receives the extended latch bolt assembly when the door is in the closed position. Typically, when the door is in an open position, the latch bolt assembly extends out from beyond the front plate of the hingedly-mounted door. As the door enters the closed position, the latch bolt assembly slideably retracts as it passes across the curved portion of the strike plate. The retracted latch bolt assembly further slides along the strike plate until it reaches the opening in the strike plate, whereupon the latch bolt assembly extends under spring bias until it fully protrudes into the jamb pocket latching the door in the closed position. With the latch bolt assembly in its extended position and protruding inside the jamb pocket, the door is latched closed. Rotating either inner or outer door knob about its radial axis will retract the latch bolt assembly, freeing the door to open.

Some individuals may have some physical limitation which renders it difficult or impossible use standard door knobs. An individual in a wheelchair, for example, may have great difficulty maneuvering into a position to use a door having a standard door knob. In other situations, an individual may simply not want to activate door knobs or handles to unlatch a closed door. It may be desirable for an interior door to remain latched and in the closed position when not in use, but disengaged when an individual or an object nears the door, so that one must only apply a slight pushing force on the door itself to open it.

Several variations upon the conventional door latching device are known to exist. For example, U.S. Pat. No. 3,521,921 to Miyazaki (1970) discloses an electromagnetically actuated locking mechanism providing automatic or manually controlled locking of a door. The locked/unlocked and open/closed status of the door and lock are electrically monitored by signal lights. In one embodiment of the Miyazaki invention, a solenoid is located behind the strike plate. When a switch is closed, the solenoid is activated and pushes a head through the keeper area until the head is flush with the strike plate, thus expelling any latch or lock bolt from the keeper. This device requires the use of a solenoid and, for the typical individual, requires the assistance of an electrician and/or carpenter to wire and install the device, which may require the homeowner to incur a large expense. Further, a solenoid requires a higher current than can be supplied with conventional batteries and typically operates on AC power. Since the Miyazaki device is unsuited to be supplied with battery power, it needs to be wired to an existing power source which can also require the homeowner to incur a large expense.

Another door latch release device is disclosed in U.S. Pat. No. 4,679,834 to Gotanda (1987). The Gotanda device includes a stopper plate for engaging and releasing the trigger bolt, to release the locking of the latch bolt with the trigger bolt. The stopper plate is moved by a solenoid actuated by remote control. After the device has cycled through its trigger bolt and latch bolt displacements, the door swings freely on its hinges. Like the Miyazaki device, the Gotanda device uses solenoid technology. Also like Miyazaki installation of this device is complex and typically requires the assistance of a carpenter and/or electrician.

Finally, U.S. Pat. No. 5,474,342 to Smith et al. (1995) discloses a device for ejecting a spring latch bolt from the keeper in a door jamb. The ejection mechanism is directly connected to an electric motor which is controlled by a controller and trigger element. In another described embodiment, the Smith et al. ejection mechanism is driven by a pair of solenoids. This device is also difficult and expensive to install.

Thus it can be seen that there is a need for an electromechanical jamb pocket latch bolt assembly release that, when activated, will expel the latch bolt assembly from the jamb pocket enabling the door to swing freely, wherein such a device can quickly and easily be installed personally by a premises owner, without the need or expense of a carpenter or electrician, and without specialized tools. It is to the provision of such an apparatus that the present invention is primarily directed.

SUMMARY OF THE INVENTION

Briefly described, in a preferred form the present invention overcomes the above-mentioned disadvantages by providing an electromechanical jamb pocket latch bolt assembly release that, when activated, will expel the latch bolt assembly from the jamb pocket enabling the door to swing freely, and which can quickly and easily be installed personally by a premises owner, without the need for specialized tools or knowledge, and without the need or expense of a carpenter or an electrician. The present invention is designed to unlatch the latch bolt assembly of a standard door latch upon activation by some activating means such as a proximity sensor, a passive sensor, a remote control, a timer, or a pressure switch. The device could be used in the home or office where one's hands are occupied with various loads, and where freeing the hands to operate the knobs of the door may be difficult. For example, this may apply specifically to restaurant doors separating the dining area from the kitchen area, or to residential doors between an enclosed garage and the living quarters.

Another application for the present invention is in conjunction with "doggie doors." These openings are typically cut out at or near the bottom of a conventional door. The cut-out is sized so that a domesticated animal such as a dog or cat can comfortably move through it. The doggie door is usually hinged at the top edge, and left free to swing open when the animal pushes the door with its head. These small openings rarely require locks and are used so that the animals may freely move between the inside and outside of a residence, or between different rooms of a house, without requiring a person to open the doggie door by hand. A closed, latched doggie door provides a barrier between the inside and the outside, or between adjacent rooms within a house, and, among other things, keeps the outside weather elements out. The doggie door may further incorporate weather-stripping and the like to keep the opening insulated when closed. According to one form of the present invention, a small transmitter or triggering device can be provided, for example, in the animal's collar to remotely activate a latch bolt assembly release, substantially as described above, to permit the door to open freely when the animal is in proximity to the doggie door. Otherwise, the doggie door remains latched closed, secure from opening from an unexpected, external pushing force, or from other animals.

In preferred form, the jamb pocket latch bolt assembly release apparatus of the present invention comprises an actuating means for unlatching the latch bolt assembly. The actuating means preferably comprises a drive means such as a motor that is coupled to a bolt contacting means or ram by a transmission means comprising a collar and a screw. The collar and screw are partially encircled on two opposing sides by a mount. The motor rotationally drives the screw, which in turn, slides the ram between a retracted position and an extended position. In the retracted position, the ram is withdrawn from the jamb pocket, allowing the latch bolt assembly to engage the jamb pocket, latching the door. In the extended position, the ram's outer face is generally flush with the strike plate, filling the jamb pocket and expelling the latch bolt assembly past the strike plate.

In one disclosed embodiment of the jamb pocket latch bolt assembly release, a controller is provided, comprising two micro-switches placed on the mount at two different positions, whereby the micro-switches will sense when the ram is in either the extended or the retracted position, signaling the device of the ram's position. The controller preferably also incorporates a timer which allows the ram to remain in the extended position for a predetermined interval, allowing the door to be freely opened. At the end of this interval, the ram automatically returns to the retracted position, to latch the door when it is closed. Without a timing device of this sort, the ram will remain in the extended position until signaled again to return to the retracted position.

The jamb pocket latch bolt assembly release apparatus is preferably supplied with direct current from a power source such as one or more dry-cell batteries, so that the device can be installed without rewiring. The batteries may be fixed behind the motor in the device's housing, or may be self-contained in a separate battery pack.

The present invention can be activated to eject the latch bolt assembly from the jamb pocket in several ways. In one embodiment of the jamb pocket latch release assembly, the device can be activated by remote control. At the push of a button within the range of the remote control receiving device, the apparatus would activate. In another embodiment, the device can be activated by means of a hard-wired switch mounted to a wall or door in much the same manner and configuration as a standard light switch. In a third embodiment, a pressure sensitive switch can activate the displacement of the ram. For example, the pressure sensitive switch can be incorporated in or under a door mat, and activate the apparatus upon being triggered by a wheelchair as it rolls on the mat, or by the steps of an animal or person. In a fourth embodiment, the device can be activated by a timer that moves the ram to the extended and retracted positions at predetermined, preprogrammed times. Alternative activation means may include, for example: proximity sensors using infrared, radio waves, sound waves, or other signals to sense an object; or passive sensors which can identify an individual or an object and, based upon that identification, permit or deny access.

Accordingly, it is an object of the present invention to provide a jamb pocket latch bolt assembly release apparatus that, when activated, will expel the latch bolt assembly from the jamb pocket enabling the door to swing freely, which assembly can be installed personally by a premises owner, without the need or expense of a carpenter or an electrician, and without specialized tools.

It is a further object of the present invention to provide an ejection device for a latch bolt assembly that can be operated by individuals with some physical limitation, wherein those individuals have difficulty using knobs or handles to unlatch a closed door.

It is a further object of the present invention to provide a jamb pocket latch bolt assembly that can be activated remotely, by a switch, or by a timer.

It is an additional object of the present invention to provide an ejection device for a latch bolt assembly that can be used in conjunction with "doggie doors." A small triggering device in the animal's collar remotely activates the latch release when the animal is in proximity to the doggie door, otherwise the doggie door remains latched closed, secure from opening by an unexpected, external pushing force.

These and other objects, features, and advantages of the present invention will become more apparent upon reading the following specification in conjunction with the accompanying drawing figures.

DETAILED DESCRIPTION OF THE PREFERRED EMBODIMENTS

Figure 1:
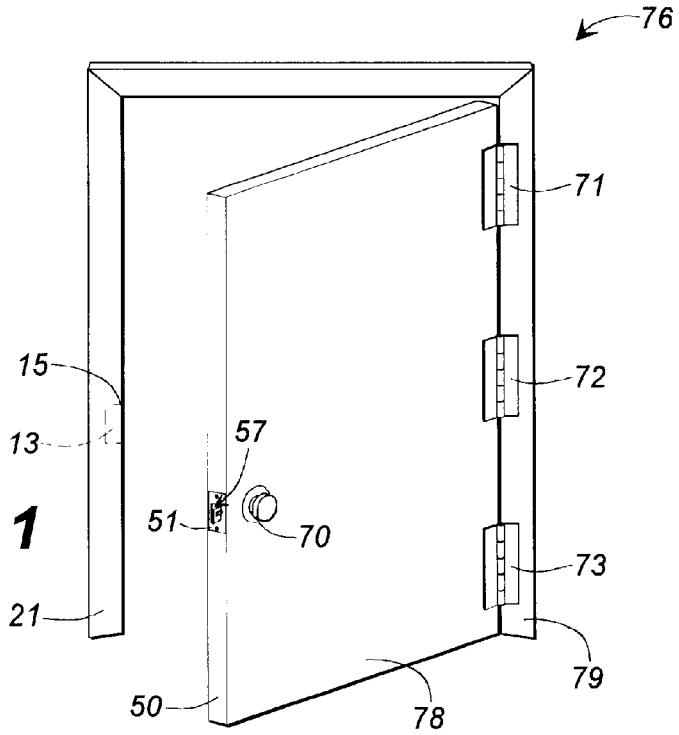
FIG. 1 is a perspective view of a standard door and jamb assembly.

Referring now in detail to the drawing figures, wherein like reference numerals represent like parts throughout the several views, FIG. 1 the shows a conventional door assembly 76. A door 78 is hingedly connected to a door frame 79 by one or more hinges 71, 72, 73. The door 78 can swing freely on the hinges 71, 72, 73 when the door 78 is unlatched from the jamb pocket 13. The door 78 incorporates a door knob 70 shown fixed on the outer surface of the door 78. The door knob 70 directs the extension and retraction of a latch bolt assembly 57. A second knob fixed to the inner surface of the door 78 is not shown. The door knob 70 may, in conventional form, further incorporate locking devices (unshown) in the form push buttons, rotational buttons or keys to disable door knob 70 from actuating the latch bolt assembly 57. The door 78 is shown in an open position, wherein the latch bolt assembly 57 is shown extending beyond a front plate 51.

The front plate 51 is fixed on doorwidth 50 in proximity to the latch bolt assembly 57. When the door 78 is in the closed and latched position, the latch bolt assembly 57 extends into a jamb pocket 13 recessed in the door jamb 21. The jamb pocket 13 is located behind a strike plate 15 mounted to the door jamb 21. The strike plate 15 has an opening or mortise therethrough, which defines the entranceway to the jamb pocket 13.

When the door 78 is in the open position, the latch bolt assembly 57 extends out from beyond the front plate 51. As the door 78 enters the closed position, the latch bolt assembly 57 slideably collapses as it passes across the strike plate 15. The latch bolt assembly 57 further slides along the strike plate 15 until it fully protrudes into the jamb pocket 13, latching the door 78 in the closed position. With the latch bolt assembly 57 in its extended position and protruding inside the jamb pocket 13, the door 78 is latched closed. Rotating door knob 70 about its radial axis will retract the latch bolt assembly 57, freeing the door 78.

Figure 2:
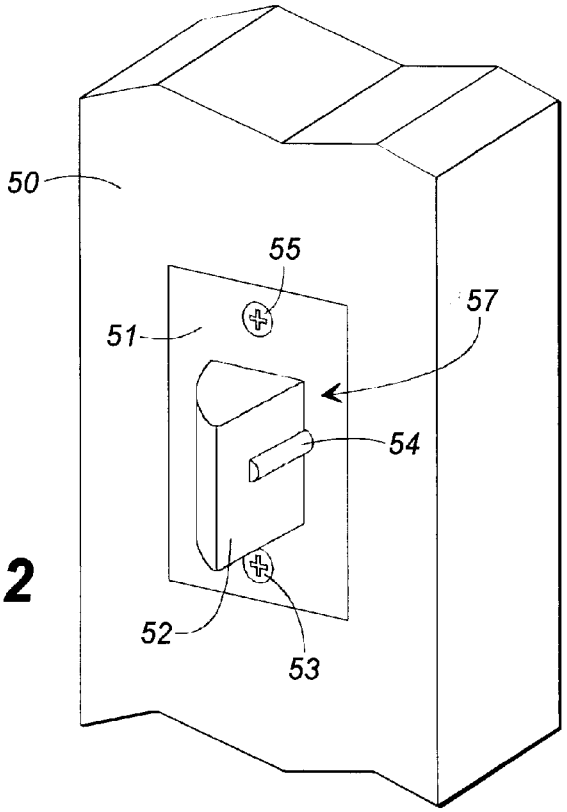
FIG. 2 is a perspective view of a prior art latch bolt assembly.

FIG. 2 shows a prior art latch bolt assembly 57. The latch bolt assembly 57 comprises a latch bolt 52 and a trigger bolt 54. Both latch bolt 52 and trigger bolt 54 protrude through the front plate 51. The front plate 51 is a generally flat, metallic component, generally rectangular in shape, and is secured to the doorwidth 50 by screws 53 and 55. The latch bolt assembly 57 may comprise both latch bolt 52 and trigger bolt 54, or, depending on the level of sophistication, the latch bolt assembly 57 may comprise latch bolt 52 alone, without a trigger bolt 54. Both the latch bolt 52 and the trigger bolt 54 slideably move through a mortise in the front plate 51. The doorwidth 50 is located opposite the doorwidth hingedly attached to the door frame 79 connecting the door 78 with door frame 79 by hinges 71, 72, 73. For simplicity, attention will be directed to that variety of door latching devices that comprise of latch bolt 52 alone. It will be understood, however, that application of the present invention is not so limited. The jamb pocket latch assembly release of the present invention is designed to eject any spring-biased element or elements protruding into the jamb pocket 13, regardless of the sophistication of the latching device, as long as the device is constructed in a manner which enables the elements protruding into the jamb pocket 13 to slideably collapse and be ejected from the jamb pocket 13 upon the application of a lateral pushing force. Therefore, a latch bolt assembly 57 including a latch bolt 52 either alone or in conjunction with a trigger bolt 54 can be used, as can other latch bolt assemblies that function to latch door 78 to door jamb 21 in the same or similar manner.

Figure 3:
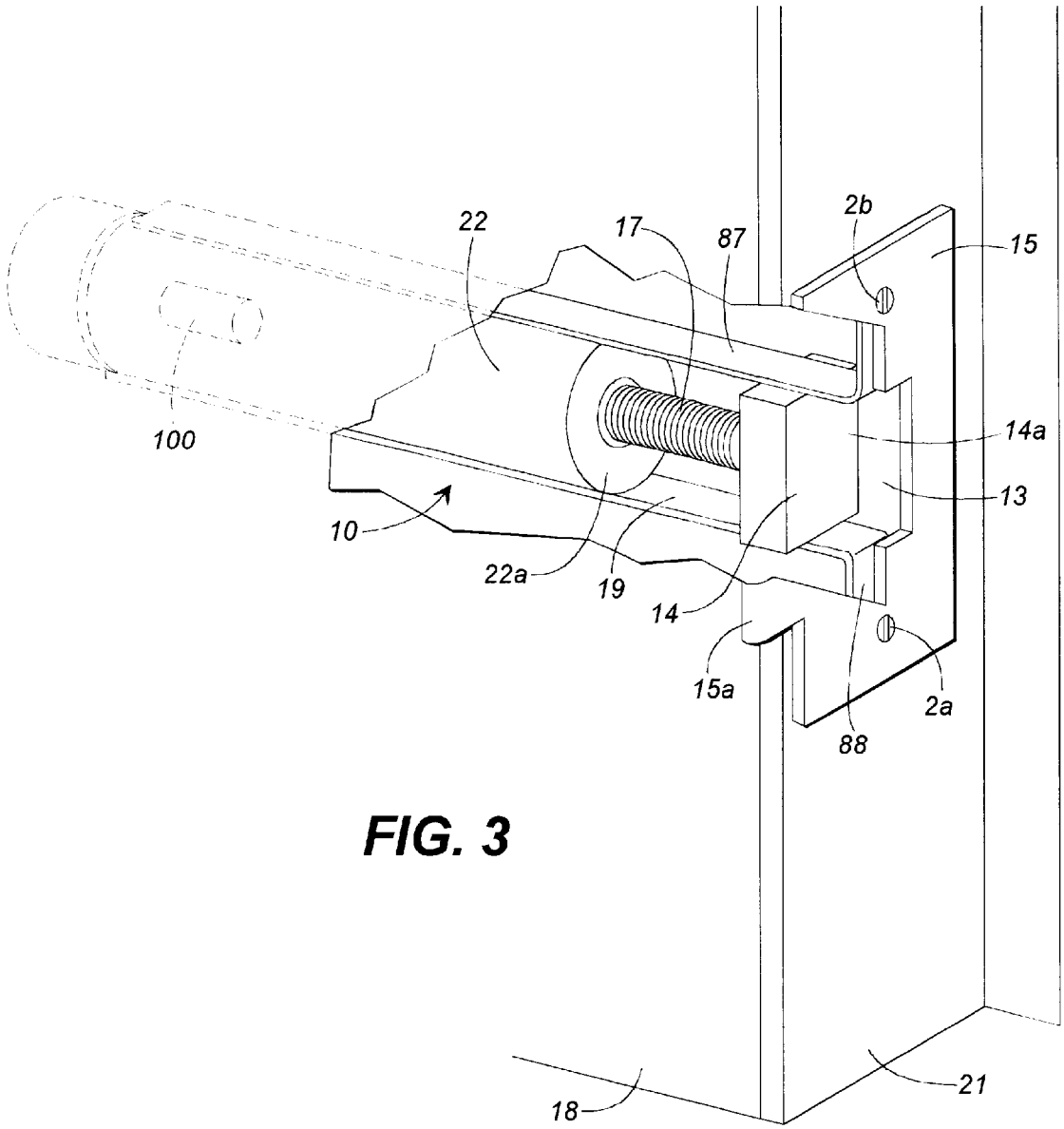
FIG. 3 is a perspective view of a jamb pocket latch bolt assembly release according to one form of the present invention, shown installed in the jamb pocket of a typical door frame.

Referring now to FIG. 3, a first embodiment of the jamb pocket latch assembly release apparatus 10 of the present invention preferably comprises a bolt contacting means such as a ram 14, which is moveable between a retracted position (shown) and an extended position (not shown). In the retracted position, the jamb pocket 13 is capable of receiving the latch bolt assembly 57, whereas in the extended position, an outer face 14*a* of the ram 14 is generally flush with the strike plate 15, contacting the latch bolt and thereby collapsing and expelling the latch bolt assembly 57 from the jamb pocket 13 and unlatching the door to open freely.

The apparatus 10 is positioned generally behind strike plate 15 in the door jamb 21, within the wall 18. The strike plate 15 frames the jamb pocket 13, and is secured by screws 2*a* and 2*b* to the door jamb 21. The strike plate 15 is a generally flat, metallic component, incorporating a rounded edge 15*a*. A mortise is provided, generally in the center of the strike plate 15, to allow the jamb pocket 13 to receive the latch bolt assembly 57 as it protrudes from the front plate 51 into the jamb pocket 13, thereby latching the door 78. The mortises in the front plate 51 and in the strike plate 15 are of approximately the size and shape, and are generally aligned adjacent one another when the door is in the closed position, to allow the latch bolt assembly 57 to slideably move between its extended and retracted positions without interference.

As shown in FIG. 3, actuating means are preferably provided for driving the ram 14 between its extended and retracted positions. The actuating means preferably comprises a drive means, such as a motor, coupled to a transmission means such as a screw 17. The contacting means, the drive means, and the transmission means are preferably generally linearly aligned in an arrangement that allows the rotation of the screw 17 to extend or retract the ram 14. This can be accomplished by connecting the ram 14 and the screw 17 with a rotational bearing, or by providing a ram 14 of generally circular cross-section which can rotate within the jamb pocket 13 along with the screw 17. The screw 17 is rotationally driven by the motor to slideably move the ram 14 linearly between its extended and retracted positions. Although a motor and screw are the preferred actuating means, alternate actuating means are also envisioned, including: polished solid rod and ball drive linear actuators, rack and pinion drives, solenoid-actuated linear actuators, or belt drives. As discussed in greater detail below, however, whatever actuating means is utilized should provide linear movement to the contacting means between the extended and retracted positions, and be configured in generally linear alignment with the contacting means and the jamb pocket.

The apparatus 10 preferably comprises a generally cylindrically shaped housing 22. Housing 22 preferably houses the motor (unshown) for rotationally driving the screw 17, and a power source for energizing the motor, such as one or more dry cell batteries (unshown). The front face 22*a* of the housing 22 preferably comprises a threaded bearing element which engages the screw 17 to effect extension and retraction of the screw 17 as the screw 17 is rotationally driven by the motor.

A controller is preferably also enclosed within the housing 22 for activating and de-activating the apparatus 10, and controlling its operation. The controller preferably includes a sensor for sensing some object near the door, or a receiver for receiving a signal from an external transmitter to activate the apparatus. The controller preferably also comprises a switching means for controlling the rotational direction of the motor/screw arrangement, and thereby controlling the direction in which the ram 14 is driven. In preferred form, the switching means comprises one or more position-sensing microswitches, one of which, when tripped by the ram 14 entering the extended position upon actuation, deenergizes the motor and activates a timer. The timer, in turn, counts a predetermined time interval and, thereafter, trips a relay, which relay reverses the polarity of the power supply to the motor and re-energizes the motor in reverse direction. The motor then returns the ram 14 to its retracted position, whereupon a second microswitch deenergizes the motor and reverses the polarity of the power supply to place the apparatus in a "ready" mode.

As shown in FIG. 3, the apparatus 10 further comprises a bracket 87 attached to the housing 22, which is preferably installed into the hole drilled into wall 18 and fixed to the wall 18 behind the strike plate 15 by means of an offset flange 88. Flange 88 is offset generally perpendicularly to the bracket 87. Flange 88 preferably includes holes which are positioned to accept screws 2*a* and 2*b* which attach the strike plate 15 to the door jamb 21.

Figure 4:
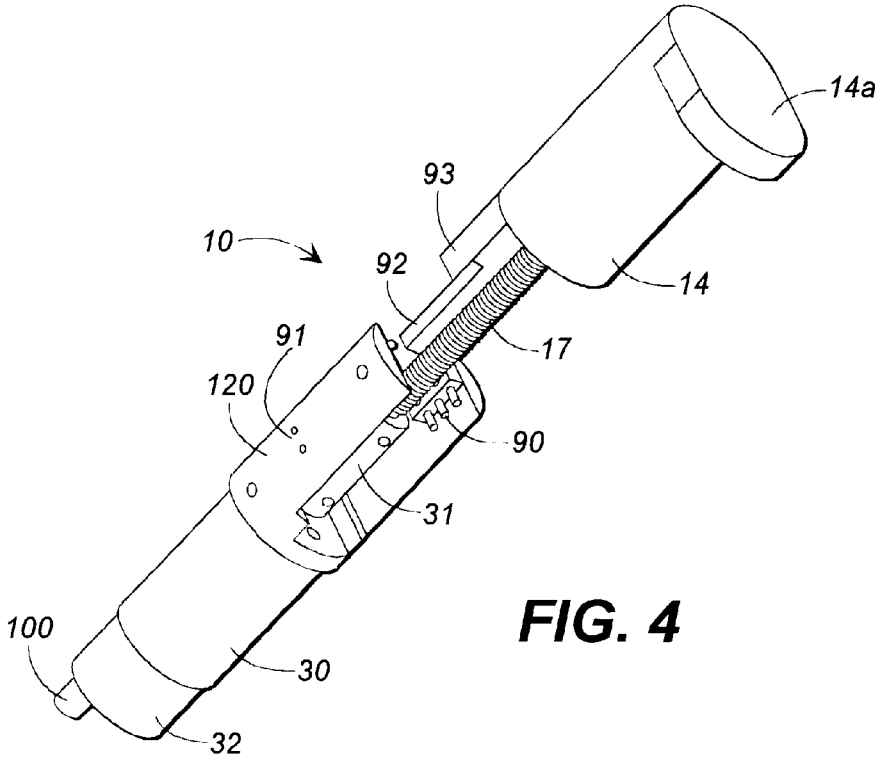
FIG. 4 is a perspective view of a jamb pocket latch bolt assembly release according to another form of the present invention.

An alternate and more preferred embodiment of the present invention is shown in FIG. 4. In this embodiment, the actuating means also comprises a transmission means such as the screw 17, driven by a drive means such as the motor 30. The motor 30 rotationally drives the screw 17 to move the ram 14 linearly between the retracted and extended positions. The collar 31 connects the screw 17 to the motor shaft (unshown). The motor 30 is preferably powered by direct current from a battery source which may be housed in a housing attached to the motor 30, or which may be remotely located. A mount 120 encircles the collar 31 and screw 17 on two sides. A controller 32, generally as described above, can be attached to the motor 30 and, in preferred form, can include a receiver 100 for receiving a sinal from an external transmitter to activate the apparatus.

Figure 5:
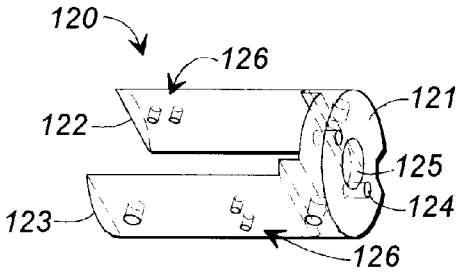
FIG. 5 is a perspective view of the jamb pocket mount element of the jamb pocket latch bolt assembly release shown by FIG. 4.

FIGS. 5–8 show details of the primary components of the jamb pocket latch bolt assembly release 10 as shown in FIG. 4. FIG. 5 shows greater detail of the jamb pocket mount 120. The jamb pocket mount 120 preferably comprises a generally circular base 121 having a pair of arms 122, 123 projecting therefrom. The jamb pocket mount 120 also preferably comprises one or more mounting holes 124, for mounting the jamb pocket mount 120 to the motor 30 by attachment means such as screws, rivets or pins. Alternatively, adhesives or pressure connections can be utilized to attach the jamb pocket mount 120 to the motor 30. The jamb pocket mount 120 also preferably includes a motor shaft opening 125, through which the shaft (unshown) of the motor 30 extends. Switch mounting holes 126 can also be provided on the arms 122, 123 of the jamb pocket mount 120 for mounting one or more microswitches, as will be described more fully below.

Figure 6A:
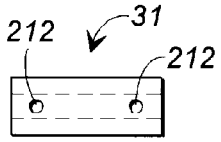
FIG. 6*a* is a side elevational view of the jamb pocket collar element of the jamb pocket latch bolt assembly release shown by FIG. 4.
Figure 6B:
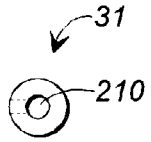
FIG. 6*b* is a front elevational view of the jamb pocket collar of FIG. 6*a*.

FIGS. 6*a* and 6*b* show greater detail of the jamb pocket collar 31. The jamb pocket collar 31 is preferably an elongate cylindrical tube having a passageway 210 therethrough. The diameter of passageway 210 is adapted to receive the shaft of the motor 30, and the unthreaded portion of the screw 17 described below, with an interference or force fit. Connection openings 212 can be provided through the jamb pocket collar 31 to receive connecting pins (unshown) to securely fasten the jamb pocket collar 31 to the motor shaft and to the screw 17.

Figure 7A:
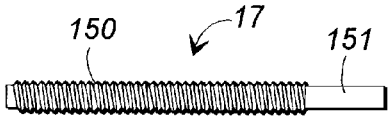
FIG. 7*a* is a side elevational view of the jamb pocket screw element of the jamb pocket latch bolt assembly release shown by FIG. 4.
Figure 7B:
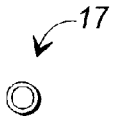
FIG. 7*b* is a front elevational view of the jamb pocket screw of FIG. 7*a*.

FIGS. 7*a* and 7*b* show the jamb pocket screw 17. The screw 17 comprises a threaded length 150 and an unthreaded length 151. Unthreaded length 151 is preferably of a diameter approximately equal to the diameter of the shaft of the motor 30, and is coupled to the shaft of the motor 30 by means of the collar 31.

Figure 8:
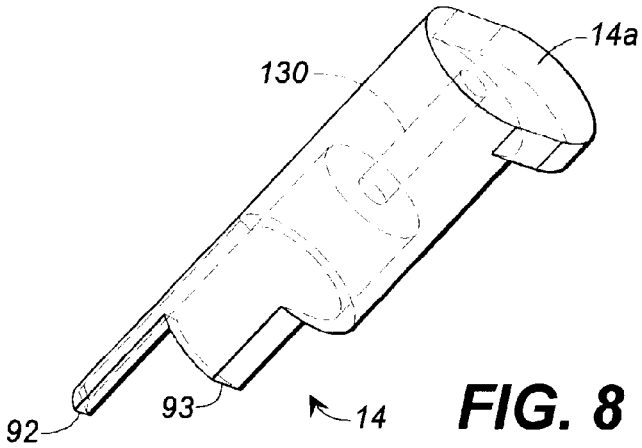
FIG. 8 is a perspective view of the jamb pocket ram element of the jamb pocket latch bolt assembly release shown by FIG. 4.

As the screw 17 rotates, its threads engage corresponding female threads 130 in the ram 14, shown in greater detail in FIG. 8. A portion of the ram 14 is shaped or otherwise configured in a manner which does not permit the ram 14 to rotate within the jamb pocket 13. Thus, as the screw 17 rotates in one direction in engaging relation with the threads 130 in the ram 14, ram 14 slideably moves into the retracted position. As screw 17 continues to rotate, screw 17 engages progressively more length of female threads 130. In this manner, ram 14 slides laterally, without rotation within the jamb pocket 13. The length of female threads 130 is at least approximately equal in length to the distance between the extended and retracted positions of ram 14. As screw 17 rotates in the opposite direction, its threads 150 disengage progressively more length of female threads 130, and therefore ram 14 enters the extended position, thereby ejecting latch bolt assembly 57 from jamb pocket 13.

The jamb pocket ram 14 comprises an outer face 14*a* having a shape generally corresponding to the mortise or opening through the strike plate 15, thereby allowing the outer face 14*a* of the ram 14 and the outer face of the strike plate 15 to present a generally smooth and uninterrupted planar surface when the ram 14 is in its extended position. In preferred form, the ram 14 can further comprise one or more position indicating means, such as projections 92, 93, which enable position sensing means to detect when the ram 14 is moved into various positions, as more fully described below. The distance between projections 92 and 93 is approximately equal to the length of female screw threads 130 within the ram 14, which, in turn, is approximately the same as the distance between the extended and the retracted position for ram 14.

In preferred form, the apparatus 10 shown by FIG. 4 generally comprises a power source such as a battery, a drive means such as the motor 30, a transmission means such as the screw 17, and a bolt contacting means such as the ram 14, all of which elements are generally linearly aligned with one another to form a generally elongate cylindrical assembly. Thus, the axis of rotation of the shaft of the motor 30, the rotational axis of the screw 17, and the central axis of the threaded opening 130 in the ram 14 are all aligned in the direction of extension and retraction of the ram 14. The maximum external diameter of the assembly is preferably less than half the thickness of the door with which the assembly is to be used, so that the door jamb is not significantly weakened by the hole required to receive the assembly. Typically, for installation in a door jamb housing a 1¾" door, the maximum outer diameter of the assembly is ¾", which enables the assembly to be installed in an approximately ⅞" hole drilled into the door.

The jamb pocket latch bolt assembly release apparatus 10 can further comprise controller means including one or more position sensing means, such as microswitches 90, 91, to detect when the ram 14 is in the retracted position and in the extended position. As shown in FIG. 4, microswitches 90, 91 are located on the arms 122, 123 of the mount 120. When the ram 14 is in its fully extended position, flush with the strike plate 15, wherein the latch bolt assembly 57 is expelled from the jamb pocket 13, switch 90 will sense a portion of the ram 14, such as the projection 92, in a position adjacent the switch 90 and will trip, stopping motor 30 from further extending ram 14 via screw 17. As ram 14 moves in the opposite direction, and enters its retracted position, projection 93 approaches switch 91, which is tripped when the ram 14 reaches the fully retracted position, thereby deactivating motor 30 from further retracting ram 14. The sensing means can be, for example, mechanical switches, which are physically tripped by the projections 92, 93 on the ram 14. Non-contact sensing means, such as LED sensors or capacitance sensors may alternatively be utilized.

Figure 9:
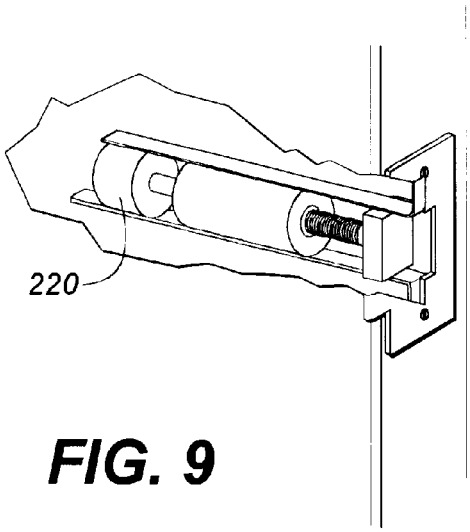
FIG. 9 is a perspective view of a jamb pocket latch bolt assembly release according to another form of the present invention and including a timer device.

In preferred form, the controller means of the apparatus 10 may further incorporate a timing means 220 as shown in FIG. 9. The timer 220 is connected to the motor 30, and allows ram 14 to remain in the extended position for a predetermined interval and thereafter re-activates motor 30 to return ram 14 to the retracted position. In this embodiment, the ram 14 extends and expels latch bolt 57 from the jamb pocket 13, remains in the extended position for a predetermined amount of time, and thereafter retracts, so that latch bolt assembly 57 may again engage jamb pocket 13 upon closing of the door. The interval of time may be, for example, the amount of time it takes an individual in a wheelchair to pass through the door 78 after activating apparatus 10 to expel latch bolt 57 from jamb pocket 13. The individual has enough time to push through door 78, and a short time later, door 78 again latches closed. In another embodiment, the timer may be incorporated with a "doggie door," unlatching the doggie door for a predetermined interval of time during which an animal may safely move through the doggie door while it is unlatched. After the animal has gone through the doggie door, the timer 220 signals the apparatus 10 to re-activate in the reverse direction, and ram 14 moves to the retracted position, allowing the doggie door to latch closed, without any further activation from man or animal.

The present invention can be activated in many ways, some of which described below and shown in FIGS. 10–14. For example, the apparatus 10 can be activated by a proximity sensor utilizing infrared signals, sound waves, radio waves, or other signals for sensing an object in the proximity of the door. Alternatively, a passive sensor can be utilized to actuate the apparatus. One preferred variety of passive sensor incorporates an identifying card or chip which is carried by a person or mounted on an object such as, for example, a wheelchair. Radio waves emitted by a transmitter mounted adjacent the door induce current in the passive card or chip, which then emits an identification signal which is received and processed to allow or deny access, depending upon whether the correct identification signal is received.

Figure 10:
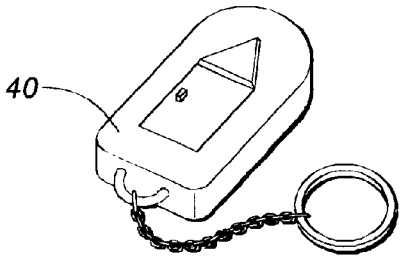
FIG. 10 is a perspective view of a remote control device to activate a jamb pocket latch bolt assembly release according to one embodiment of the present invention.

Alternatively, the apparatus 10 can be activated by a remote control switch. As shown in FIGS. 3 and 4 remote control receiver 100 can receive a remote signal from a transmitter and control the activation and/or deactivation of apparatus 10. A remote control signal can be generated by remote transmitter 40 as shown in FIG. 10, which can be activated by a push of a button by an individual wishing to activate apparatus 10. The receiver 100 can be mounted on or near the door frame, preferably adjacent the strike plate 15. If radio wave remote control is utilized, an antenna of the appropriate length can be incorporated into the housing 22.

Figure 11:
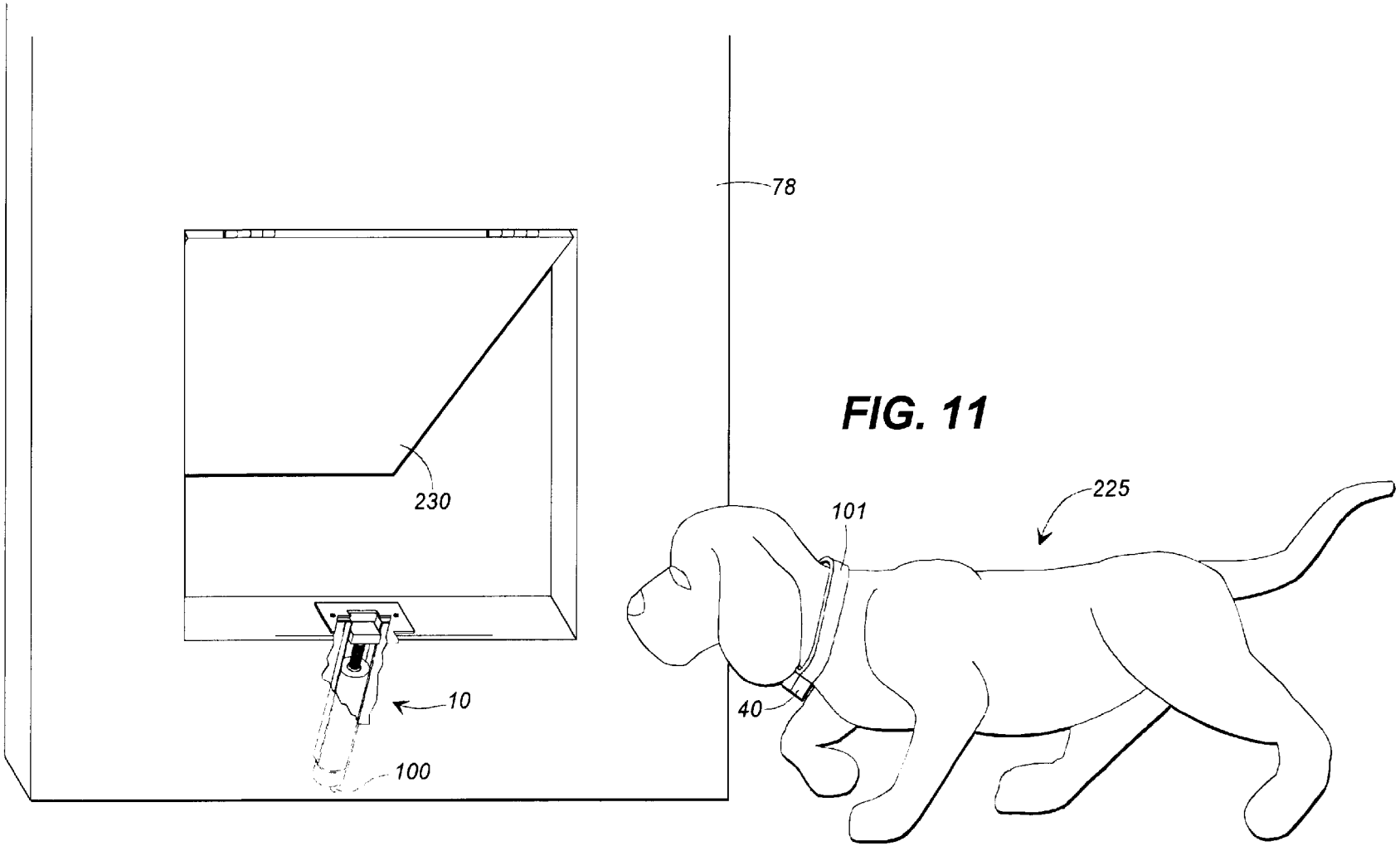
FIG. 11 is a perspective view of another embodiment of the present invention incorporating a collar-mounted transmitter for releasing a latch on a doggie door.

As shown in FIG. 11, remote receiver 100 may be activated by a signal sent by a remote transmitter 40 located in a collar 101 worn by an animal 225. As the animal 225 wearing collar 101 approaches the "doggie door" 230, the animal passes in the proximity of receiver 100, which receives a signal sent by remote 101 to activate the apparatus 10. It will be understood that the receiver 100 can be located remotely from the apparatus 10 and connected, as by a wire, to the apparatus.

Figure 12:
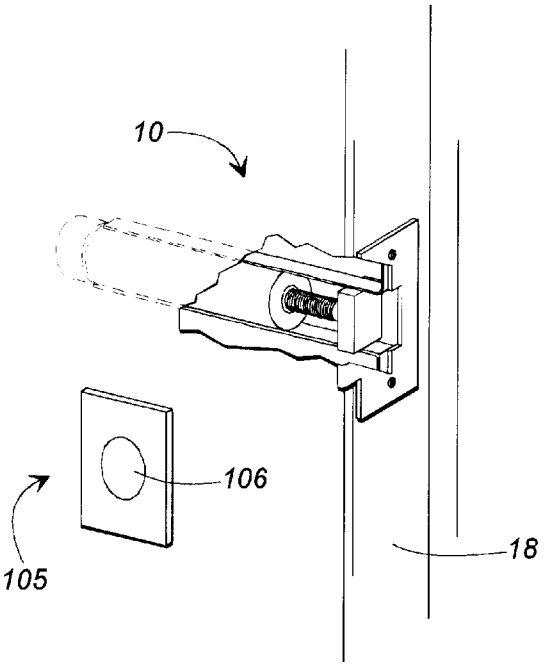
FIG. 12 is an elevational view of another embodiment of the present invention utilizing a wall-mounted switch for activating the latch release.

FIG. 12 shows another embodiment, where apparatus 10 can be activated by means of a hard-wired switch 105 mounted to wall 18 or elsewhere, in much the same manner or configuration as a standard light switch. Switch 105 may comprise a button 106 or an on/off switch, and when button 106 or switch is activated, apparatus 10 will activate. Alternatively, the switch 105 can comprise a proximity sensor of known construction. This embodiment of the apparatus 10 may be especially useful for application with an entryway to a residence, for example, between an enclosed garage and the living quarters. Installed in this manner, the present invention enables passage by a person whose hands may be full, such as when carrying groceries or other objects, and who may find it difficult to operate a standard door knob. By simply bumping the button 106 with an elbow or otherwise, the apparatus 10 will release the door latch, allowing entry by simply pushing against the door. If a proximity sensor is utilized, the person need only pass an object or body part near the sensor.

Figure 13:
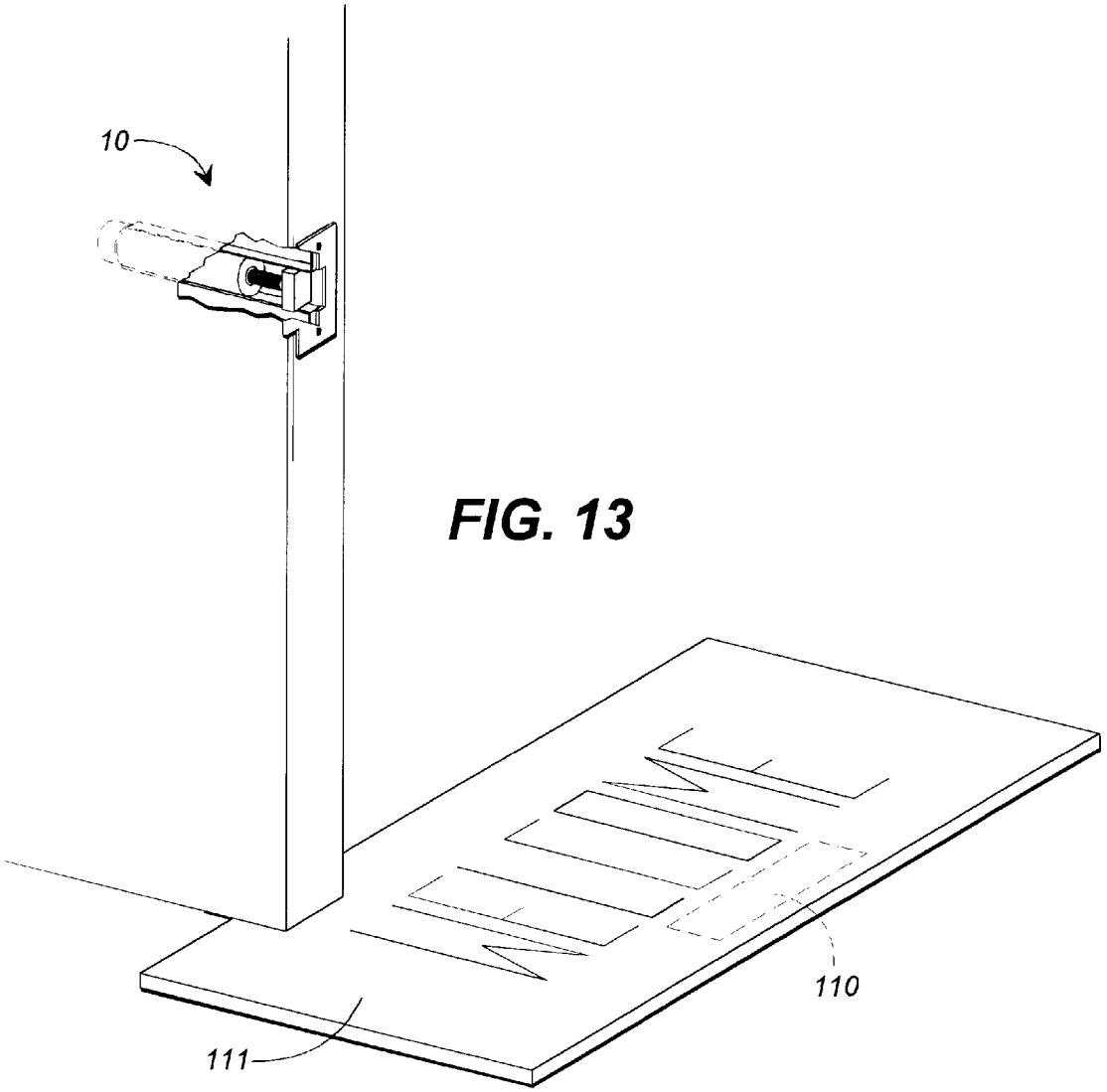
FIG. 13 is a perspective view of another embodiment of the present invention incorporating a pressure-sensitive switch.

In another embodiment, a pressure sensitive switch 110, as shown in FIG. 13, can activate the apparatus 10. Typically, the pressure sensitive switch 110 is incorporated in door mat 111. Upon pressure from a wheelchair or footsteps, the pressure sensitive switch 110 located in or adjacent the door mat 111 activates the apparatus 10. Pressure sensitive switch 110 can be hard-wired to apparatus 10, or can further incorporate a transmitter similar to remote device 40, which triggers remote receiver 100 in much the same way as described above.

Figure 14:
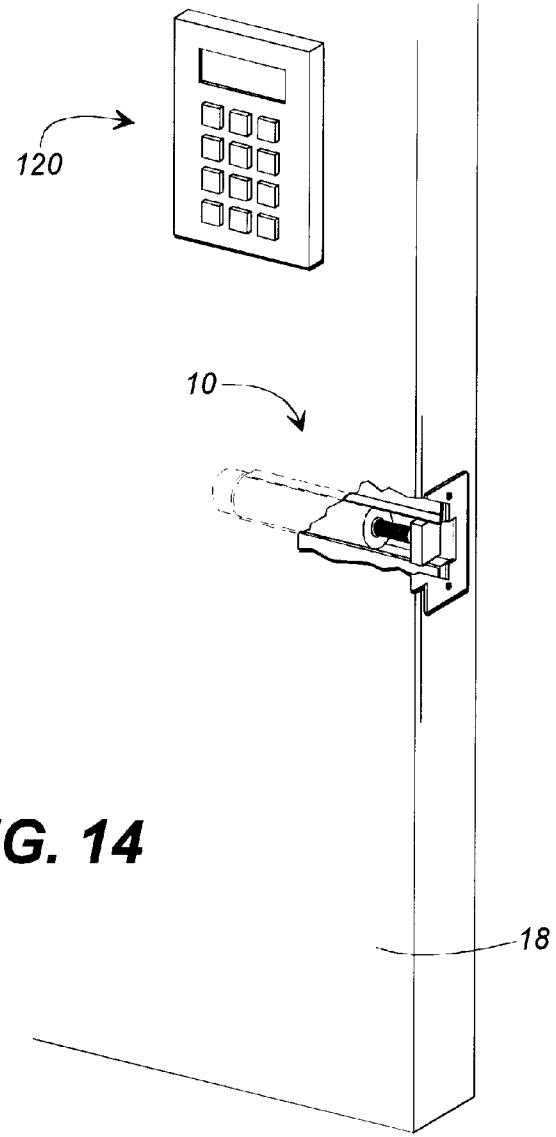
FIG. 14 is a perspective view of another embodiment of the present invention incorporating a programmable timer.

In yet another embodiment, the apparatus 10 can be activated by a programmable timer 120 mounted to wall 18, or incorporated into the apparatus 10 and programmed by keypad or remote control, as shown in FIG. 14. Timer 120 activates apparatus 10 at predetermined times of the day and/or night as preprogrammed by a user. Therefore, without intervention, door 78 is unlatched and free to operate at certain, predetermined times. As directed by timer 120, door 78 again latches as apparatus 10 activates, and enters the retracted position.

In the embodiments depicted by FIGS. 3 and 4, and described more fully above, the release apparatus 10 is preferably powered by dry cell batteries mounted within a housing attached to, or adjacent to, the motor 30, for example, in the embodiment depicted by FIG. 3, one or more dry cell batteries can be housed in the housing 22. In the embodiment depicted by the FIG. 4, a battery may be housed between the motor 30 and the controller 32.

Figure 15:
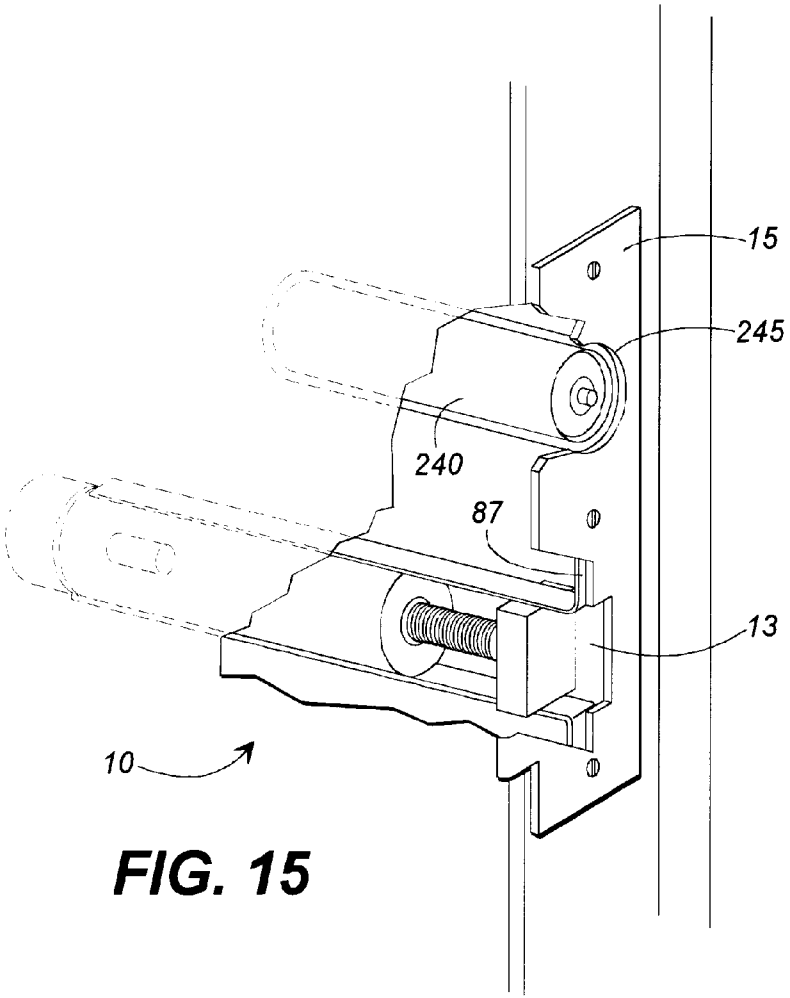
FIG. 15 is a perspective view of an embodiment of the present invention incorporating a separate battery pack.

In an alternate embodiment shown by FIG. 15, one or more batteries 240 can be provided in a separate battery pack or housing 245 adjacent the jamb pocket 13. The battery housing comprises a second hole drilled in the wall 18, through the door jamb 21. A lengthened strike plate 15 can be provided to cover the battery housing 245. Preferably, an opening in the strike plate 15 is provided to allow the battery 240 to be removed and replaced more readily. A cover (unshown) can be provided to cover this opening in the strike plate 15, and can be retained within the strike plate 15 by threads, by snap fit, or by alternate releasable attachment means. The bracket 87 attached to the housing 22 of the apparatus 10 can be extended to provide electrical contact between the battery 240 and the motor 30.

Figure 16A:
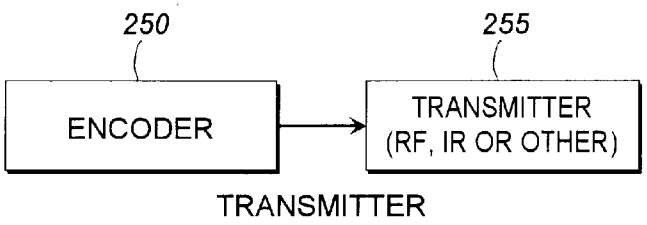
FIG. 16*a* is an electrical schematic of a preferred embodiment of the door jamb receiver and controller of the present invention.

FIG. 16*a* depicts an electrical schematic diagram of the transmitter 40 which can be used to activate the latch release apparatus 10. An encoder 250 and a transmitter 255 are provided. The encoder 250 and the transmitter 255 can be contained within the remote control apparatus 40 as depicted, for example, in FIGS. 10 and 11. The transmitter 255 can comprise a radio frequency (RF) or infrared (IR) transmitter, or a transmitter of other variety.

Figure 16B:
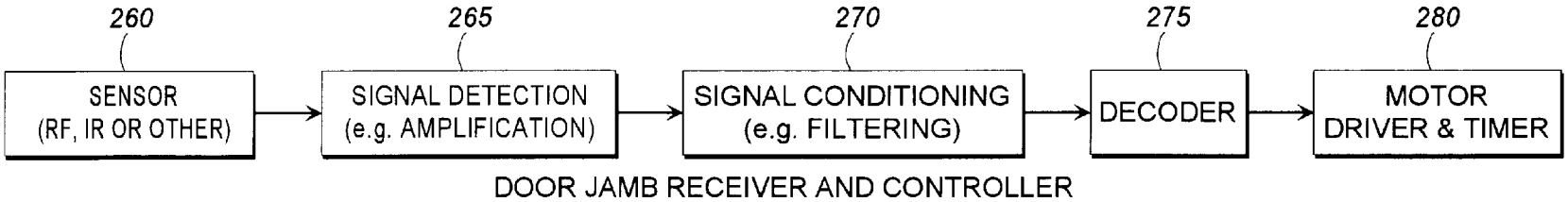
FIG. 16*b* is an electrical schematic of a preferred embodiment of a transmitter used to activate the release apparatus of the present invention.

FIG. 16*b* depicts an electrical schematic diagram of the door jamb receiver and controller, according to a preferred form of the present invention. A sensor 260, adapted to receive RF, IR, or other signals from the transmitter 255 is provided to receive a transmitted signal. This signal is detected and amplified by a signal detection means 265, is conditioned by a signal conditioning means 270 such as a filter, and is decoded by a decoding means 275. One or more signals are then sent to the motor driver 280 and/or the timer, to control the activation of the door latch release apparatus 10 as described in greater detail above.

Installation of the jamb pocket assembly release 10 is easily accomplished by the premises owner, without the need or expense of an electrician or carpenter. A standard screwdriver is used to remove screws 2*a* and 2*b* from the door jamb 21 thereby allowing removal of the strike plate 15. Upon removing the strike plate 15, the jamb pocket 13 is extended laterally through door jamb 21, into wall 18, to a depth sufficient to receive the apparatus 10. Depending on the composition of wall 18, the premises owner will likely need only a drill to sufficiently extend jamb pocket 13 into wall 18, as the overall shape of the apparatus 10 is generally that of an elongate cylinder. A chisel may also be used to create the housing space needed for apparatus 10. The motor 30 is powered by batteries which may be included in the housing of the jamb pocket latch bolt assembly release apparatus 10, or may require the drilling of a second hole directly above strike plate 15, within the wall 18 for receiving a battery pack 140 which is placed in electrical contact with the motor 30.

While the invention has been disclosed in preferred forms, it would be apparent to those skilled in the art that many modifications, additions, and deletions can be made therein without departing from the spirit and scope of the invention as set forth in the following claims.

What is claimed is:

1. An apparatus for ejecting a latch bolt assembly of a door from a jamb pocket in a door jamb adjacent the door, wherein the jamb pocket is designed for receiving the latch bolt assembly when the door is closed, said apparatus comprising:

(a) a motor having a rotationally-driven motor shaft;

(b) a screw comprising generally helical threads, said screw being coupled to said motor shaft for rotational movement about its longitudinal axis; and (c) a ram fixedly attached to the end of the screw opposite said motor, whereby rotation of said screw by said motor in a first direction imparts translational movement upon said ram to an extended position away from said motor, and whereby rotation of said screw by said motor in a second direction opposite said first direction imparts translational movement upon said ram to a retracted position toward said motor, said apparatus being designed for installation in the door jamb adjacent the jamb pocket opposite the door, so that movement of said ram to said extended position causes said ram to eject the latch bolt assembly from the jamb pocket.

2. The apparatus of claim 1, further comprising position sensing means for detecting when said ram is in said retracted position and said extended position.

3. The apparatus of claim 2, further comprising timer means for allowing said ram to remain in said extended position for a predetermined time interval and thereafter activating said motor to reurn said ram to said retracted position.

4. The apparatus of claim 1, further conmprising receiving means for receiving a signal from a remote transmitter, said signal activating said motor to move said ram between said extended and retracted positions.

5. The apparatus of claim 1, further comprising a wall-mounted switch, wherein said switch activates said motor to move said ram between said extended and retracted positions.

6. The apparatus of claim 3, further comprising a pressure sensitive switch connected to said motor, wherein when pressure is applied to said pressure sensitive switch, said switch activates said motor to move said ram between the said extended and retracted positions.

7. The apparatus of claim 6, wherein said pressure sensitive switch is connected to a transmitting device, whereby when pressure is applied to said pressure sensitive switch, said transmitting device emits a signal, and wherein said apparatus further comprises receiving means for receiving said signal and controller means for energizing said motor to move said ram between said extended and retracted position.

8. The apparatus of claim 1, further comprising programmable timer means, wherein said timer means activates said motor at predetermined times to move said ram between said extended and retracted positions.

9. The application of claim 1, wherein said apparatus is mounted within a housing, said housing being generally cylindrical and adapted to be received within a hole drilled into the jamb adjacent the door.

10. The apparatus of claim 9, further comprising a battery pack for supplying power to said actuating means, said battery pack adapted to be received within a second hole drilled into the jamb adjacent the first hole.

11. The apparatus of claim 1, further comprising controller means for controlling the direction of rotational movement of said motor shaft and thereby the direction of translational movement of said ram.

12. The apparatus of claim 11, further comprising remote signaling means for actuating said apparatus, said remote signaling means comprising a wireless remote control for transmitting a signal, said apparatus further comprising receiver means for receiving the signal and thereupon actuating said apparatus.

13. The apparatus of claim 12, further comprising a pressure switch connected to the signaling means, whereby when pressure is applied to said pressure switch, said signaling means transmits the signal.

14. The apparatus of claim 11, wherein said controller means further comprises first and second position sensing means, whereby said first position sensing means senses movement of said ram into a forward position and said second position sensing means senses movement of said ram into a rearward position, and wherein when said first position sensing means detects said ram in the forward position, said controller prevents said motor from further rotating said screw in the first direction, and wherein when said second position sensing means detects said ram in the rearward position, said controller prevents said motor from further rotating the screw in the second direction.

* * * * *